US010990031B2

(12) United States Patent
Takai

(10) Patent No.: US 10,990,031 B2
(45) Date of Patent: Apr. 27, 2021

(54) DEVELOPING DEVICE, IMAGE FORMING APPARATUS AND METHOD OF MANUFACTURING DEVELOPING DEVICE

(71) Applicant: KYOCERA Document Solutions Inc., Osaka (JP)

(72) Inventor: Hiroaki Takai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/925,206

(22) Filed: Jul. 9, 2020

(65) Prior Publication Data

US 2021/0011396 A1 Jan. 14, 2021

(30) Foreign Application Priority Data

Jul. 11, 2019 (JP) ..... JP2019-129533

(51) Int. Cl.

*G03G 15/08* (2006.01)
*G03G 15/01* (2006.01)
*G03G 15/09* (2006.01)

(52) U.S. Cl.

CPC ..... *G03G 15/0812* (2013.01); *G03G 15/0121* (2013.01); *G03G 15/0817* (2013.01); *G03G 15/0889* (2013.01); *G03G 15/0896* (2013.01); *G03G 15/09* (2013.01); *G03G 2215/0641* (2013.01)

(58) Field of Classification Search

CPC ..... G03G 15/0121; G03G 15/0812; G03G 15/0817; G03G 15/0889; G03G 15/0896; G03G 15/09; G03G 2215/0641

See application file for complete search history.

(56) References Cited

U.S. PATENT DOCUMENTS 7,257,347 B2 * 8/2007 Okamoto ..... G03G 15/0875 399/109
8,335,451 B2 * 12/2012 Kim ..... G03G 15/0896 399/103
2019/0171131 A1 * 6/2019 Koga ..... G03G 15/0812

FOREIGN PATENT DOCUMENTS

JP H05-11667 A 1/1993

* cited by examiner

*Primary Examiner* — Joseph S Wong
(74) *Attorney, Agent, or Firm* — Studebaker & Brackett PC

(57) ABSTRACT

A developing device includes an agitating member, a magnetic roller, a lower housing, an upper housing and a blade member. The lower housing includes a first housing part including a first edge having a first contact face and a first facing surface at a blade member's side. The upper housing includes a second housing part including a second edge having a second contact face contact with the first contact face and a second facing surface facing to the first facing surface. The blade member is attached to the upper housing and arranged at a gap to the lower housing. Between the first and second facing surfaces, a width at a blade member's side is broader than a width at a first contact face's side. The first and second facing surfaces are bonded by an adhesive agent. The gap is sealed by the adhesive agent.

10 Claims, 13 Drawing Sheets

I – I

Related Art

DEVELOPING DEVICE, IMAGE FORMING APPARATUS AND METHOD OF MANUFACTURING DEVELOPING DEVICE

INCORPORATION BY REFERENCE

This application is based on and claims the benefit of priority from Japanese Patent application No. 2019-129533 filed on Jul. 11, 2019, the entire contents of which are incorporated herein by reference.

BACKGROUND

The present disclosure relates to a developing device developing a latent image by using a toner, an image forming apparatus including the developing device, and a method of manufacturing the developing device.

An image forming apparatus of an electrographic manner includes a developing device developing a latent image by using a toner. As shown in FIGS. 12 and 13, a conventional developing device 160 includes a housing 310 and a cover 311. In an upper part of the housing 310, an opening 312 is formed and, inside the housing 310, a screw 330 and a magnetic roller 320 are arranged. By mounting the cover 311 to the opening 312, scattering of a developer from the housing 310 is prevented.

In the above-mentioned developing device 160, the cover 311 is attached to the housing by using bis, and when this attaching, an elastic member, such as sponge, is inserted between the housing 310 and the cover 311 to ensure sealing performance. In order to improve sealing performance, the cover 311 may be bonded to the housing 310. However, because the cover 311 prepared for preventing scattering of the developer has low rigidity, even if the cover 311 is bonded to the housing 310, the cover 311 does not contribute to improvement of strength and rigidity of the housing 310. In order to improve strength and rigidity of the housing 310, a thickness of the housing 310 may be thickened or material having high Young's modulus may be used, but problems of cost increase and of processing difficulty due to high Young's modulus may be caused. Moreover, when the cover is bonded to the housing by an adhesive agent, the adhesive agent may be protruded to the inside of the housing. In such a case, there is a problem that the adhesive agent is hardened inside the housing to obstruct agitating and conveying of the developer.

Further, the developing device is provided with a blade member restricting a layer thickness of the developer carried on the magnetic roller. Conventionally, when a gap between the blade member and the housing is sealed by a sealing element, such as sponge, simplifying of sealing is required.

SUMMARY

A developing device in accordance with the present disclosure includes an agitating member, a magnetic roller, a lower housing, an upper housing and a blade member. The agitating member rotates around an axis to agitate a developer. The magnetic roller is arranged above the agitating member and carries the developer. The lower housing includes a first housing part opened at an upper side to house the agitating member in the first housing part. The upper housing includes a second housing part opened at a lower side to house the agitating member and the magnetic roller in the second housing part, and includes an opening from which a part of an outer circumferential face of the magnetic roller is exposed. The blade member is arranged below the opening, has an upper part fixedly attached to an outer face of the upper housing, has a lower part facing to an outer face of the lower housing to make a gap between the blade member and the lower housing, and restricts a layer thickness of the developer carried on the magnetic roller. The first housing part has a first edge including a first contact face. The second housing part has a second edge including a second contact face coming into contact with the first contact face. A part of the first edge positioned between the first housing part and the blade member includes a first facing surface formed at a side of the blade member from the first contact face. The second edge includes a second facing surface facing to the first facing surface. A gap between the first facing surface and the second facing surface is made so that a width at a side of the blade member is broader than a width at a side of the first contact face. The first facing surface and the second facing surface are bonded by an adhesive agent. The gap between the blade member and the outer face of the lower housing is sealed by the adhesive agent.

An image forming apparatus in accordance with the present disclosure includes an exposing device writing a latent image on a photosensitive drum, and the developing device as described above to develop the latent image.

A method in accordance with the present disclosure for manufacturing a developing device manufactures the developing device including a lower housing including a first housing part opened at an upper side, an upper housing including a second housing part opened at a lower side, and a blade member having an upper part fixedly attached to an outer face of the upper housing, and having a lower part facing to an outer face of the lower housing to make a gap between the blade member and the lower housing. The method includes a step of forming a first contact face on a first edge of the first housing part, and a step of forming a second contact face coming into contact with the first contact face on a second edge of the second housing part. The method includes a step of forming a first facing surface on a part of the first edge positioned between the first housing part and the blade member at a side of the blade member from the first contact face, and a step of forming a second facing surface facing to the first facing surface on the second edge. The method includes a step of arranging the first facing surface and the second facing surface so that an interval at a side of the blade member between the first facing surface and the second facing surface is broader than an interval at a side of the first contact face between the first facing surface and the second facing surface. The method includes a step of applying an adhesive agent to the first facing surface, a step of making the second contact face come into contact with the first contact face, and of bonding the second facing surface to the first facing surface, and a step of fixedly attaching an upper part of the blade member to the outer face of the upper housing, and of sealing the gap between the blade member and the outer face of the lower housing by the adhesive agent flowed out from between the first facing surface and the second facing surface.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
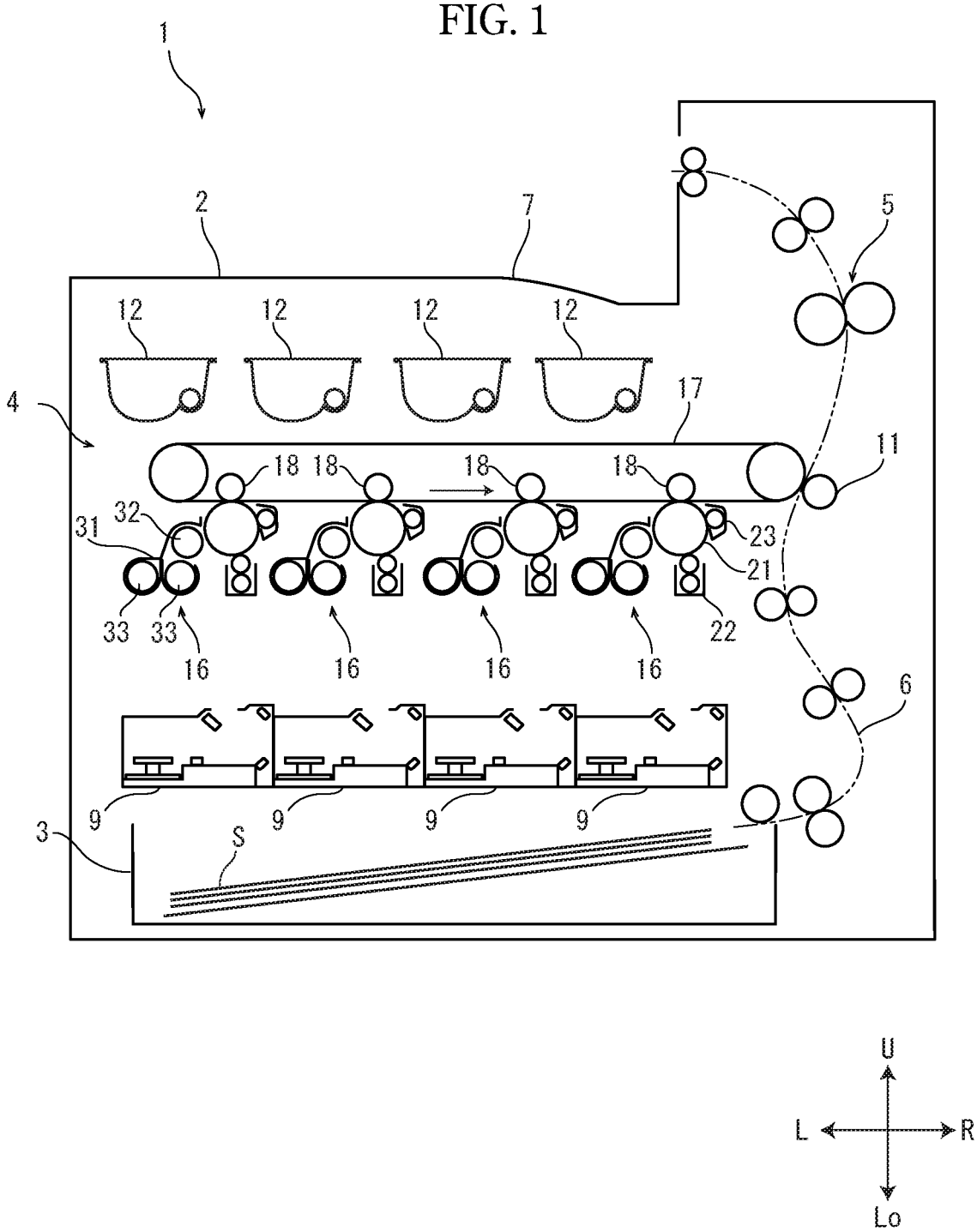
FIG. 1 is a sectional view schematically showing an internal structure of a printer according to an embodiment of the present disclosure.
Figure 2:
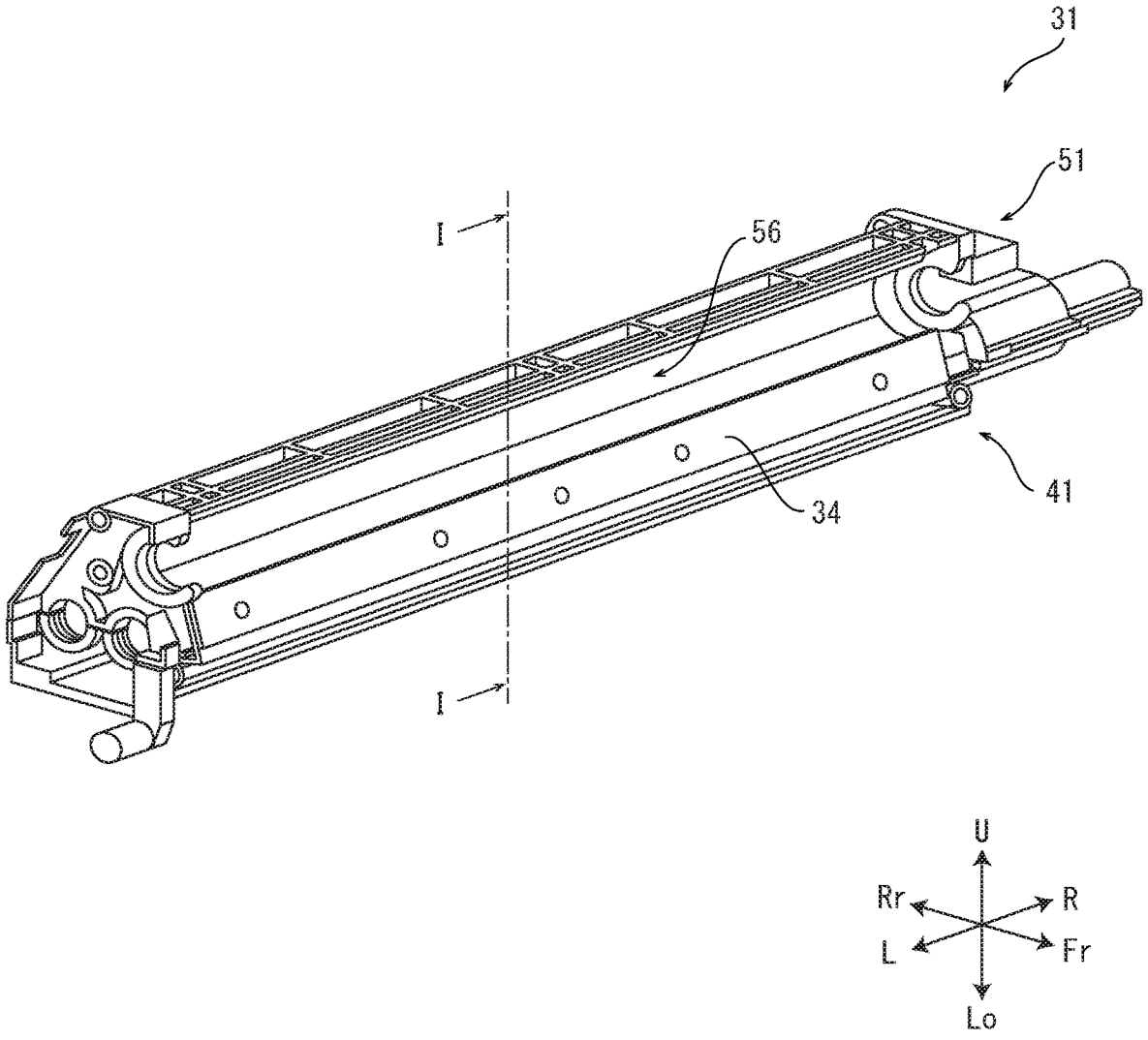
FIG. 2 is a perspective view showing an outside appearance of a housing of a developing device according to the embodiment of the present disclosure.

Hereinafter, with reference to the accompanying drawings, a printer 1 (an example of an image forming apparatus) and a developing device 16 according to an embodiment of the present disclosure will be described. FIG. 1 is a sectional view schematically showing an internal structure of the printer 1 as viewed from a front side. FIG. 2 is a perspective view showing an outside appearance of a housing 31 of the developing device 16. Hereinafter, it will be described so that the front side of the printer 1 is positioned at a near side on a paper sheet of FIG. 1 and that left and right directions are defined as seen from the front side of the color printer 1. Arrows U, Lo, L, R, Fr and Rr in each of the drawings respectively indicate an upper side, a lower side, a left side, a right side, a front side and a rear side of the printer 1.

The printer 1 includes a box-like case 2. In the case 2, a sheet feeding device 3 feeding a sheet S to a conveying path 6, an image forming part 4 forming a toner image on the sheet S, a fixing device 5 fixing the toner image on the sheet S, and an ejecting part 7 ejecting the sheet S having the fixed toner image are provided.

The image forming part 4 includes rotationally driven photosensitive drums 21, charging devices 22, exposing devices 9, developer containers 12, developing devices 16, an intermediate transferring belt 17, primary transferring rollers 18, a secondary transferring roller 11, and cleaning devices 23. The charging devices 22 electrically charge the photosensitive drums 21, respectively. The exposing devices 9 respectively irradiate the photosensitive drums 21 with laser lights based on image data to form latent images. The developer containers 12 respectively supply developers containing toners to the developing devices 16. The developing devices 16 respectively develop the latent images by the toners to form toner images. The intermediate transferring belt 17 is wound around a driving roller and a following roller. The primary transferring rollers 18 respectively transfer the toner images onto the intermediate transferring belt 17. The secondary transferring roller 11 transfers the toner images on the intermediate transferring belt 17 onto the sheet S. The cleaning devices 23 respectively clean surfaces of the photosensitive drums 21. The printer 1 includes four sets of the photosensitive drum 21, the charging device 22, the exposing device 9, the developer container 12, the developing device 16, the primary transferring roller 18 and the cleaning device 23, and forms a color toner image by toners of four colors. Incidentally, the present disclosure may be applied to another image forming apparatus forming image by toners of three or less colors or five or more colors.

Figure 4:
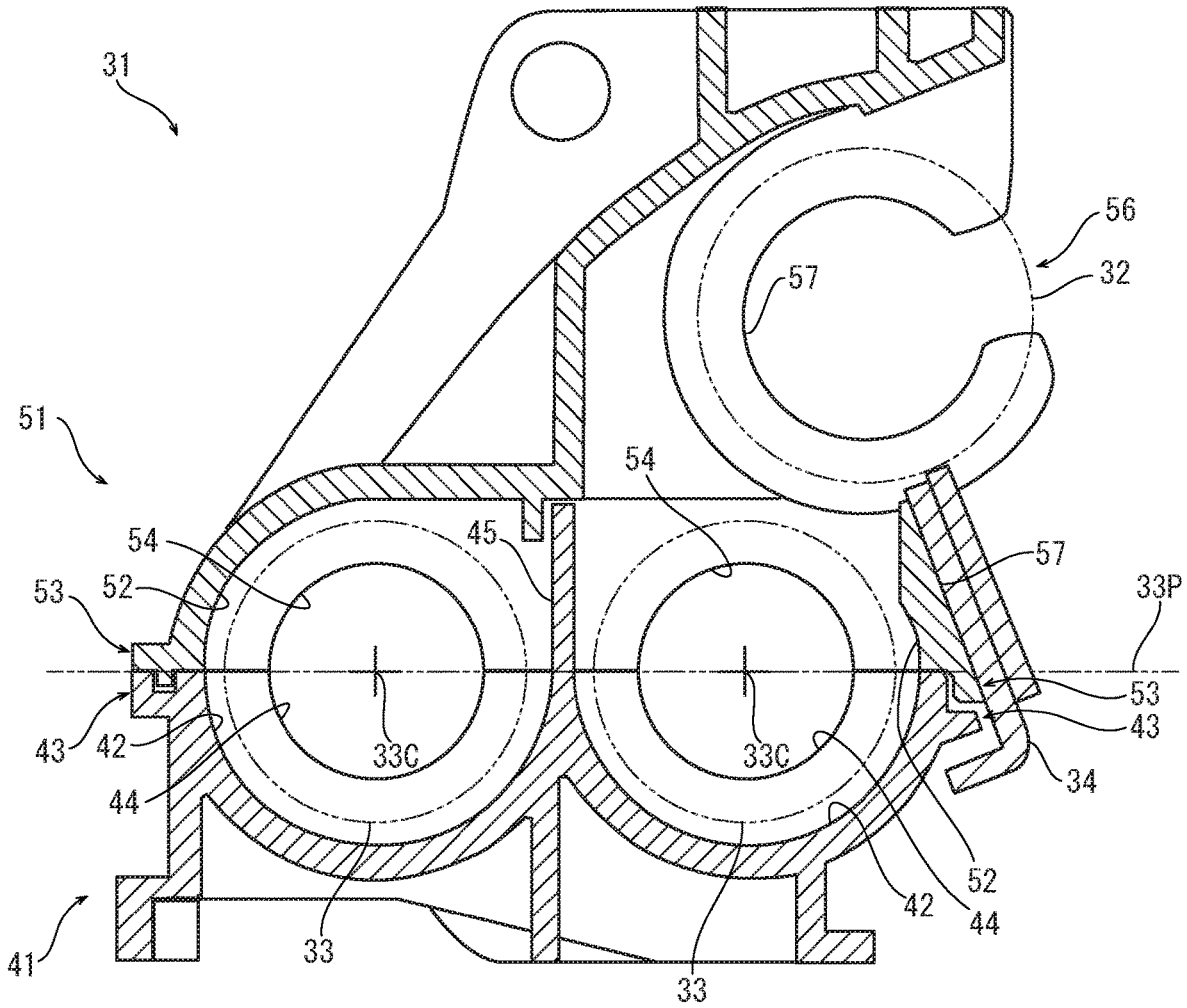
FIG. 4 is a sectional view taken along I-I line of FIG. 2.
Figure 4:
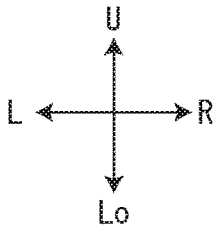

The developing device 16 includes two screws 33, a magnetic roller 32 (an example of an agitating member), a housing 31, and a blade member 34 (refer to FIGS. 2 and 4 and others). The screws 33 rotate around an axis to agitate the developer. The magnetic roller 32 is arranged above the screws 33, and carries the developer. The housing 31 houses the screws 33 and the magnetic roller 32, and includes an opening 56 from which a part of an outer circumferential face of the magnetic roller 32 is exposed. The blade member 34 is arranged below the opening 56, and restrict a layer thickness of the developer carried on the magnetic roller 32.

Between the housing 31 and the developer container 12, a supplying path (not shown) for the developer is arranged. the developer is, for example, a two-component developer containing a magnetic carrier and a nonmagnetic toner. The two screws 33 are juxtaposed in left and right directions inside the housing 31 and arranged in parallel to each other. The magnetic roller 32 is arranged above the right screw 33 in parallel to the right screw 33. The magnetic roller 32 includes a permanent magnet and a developing sleeve made by nonmagnetic material covering a periphery of the permanent magnet (not shown). The opening 56 is formed at a right side of an upper part of the housing 31, and the part of the outer circumferential face of the magnetic roller 32 exposed from the opening 56 faces to an outer circumferential face of the photosensitive drum 21.

Next, an image forming operation of the printer 1 will be described. When the printer 1 receives the image data from an external device or the like, the sheet S is fed from the sheet feeding device 3 to the conveying path 6. On the surface of each of the electrically charged photosensitive drums 21, a latent image on the basis of the image data is formed (written) by each of exposing devices 9. The developer is supplied from each of developer containers 12 to the housing 31 of each of the developing devices 16 and agitated by the screws 33 of each of the developing devices 16. The two screws 33 convey the developer in opposite directions to each other to agitate the developer in the housing 31. The toner contained in the developer magnetically absorbed to the magnetic roller 32 is absorbed to the latent image by a potential difference of the magnetic roller 32 and the photosensitive drum 21, and then, the toner image is formed.

The toner image formed on each of the photosensitive drums 21 is layered and transferred onto the intermediate belt 17 by each of the primary transferring rollers 18. The toner images transferred on the intermediate belt 17 are transferred onto the sheet S by the secondary transferring roller 11, and are fixed on the sheet S by the fixing device 5. The sheet S having the fixed toner images is ejected by the ejecting part 7.

Figure 3:
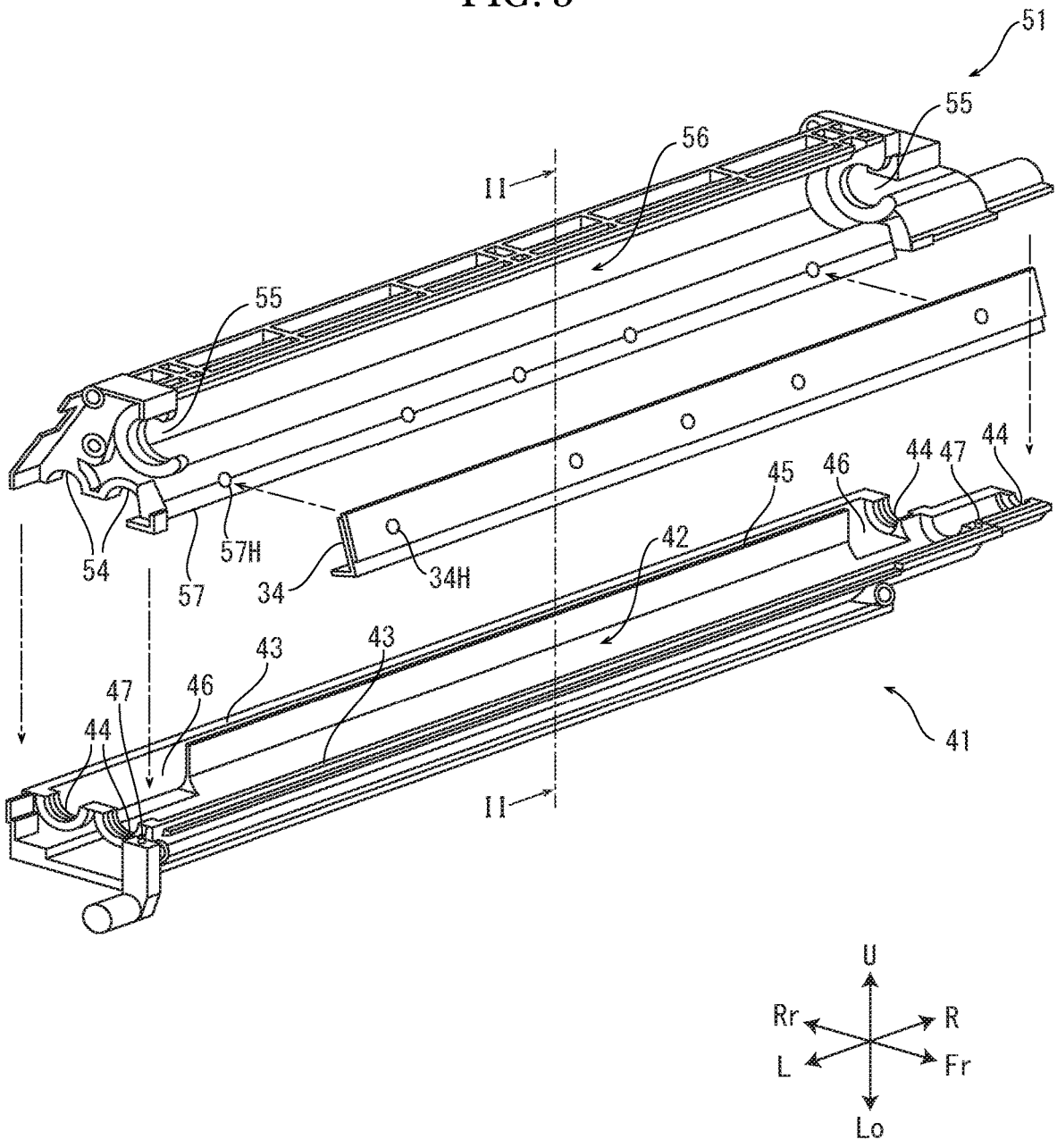
FIG. 3 is an exploded perspective view showing the housing of the developing device, in a condition before a lower housing and an upper housing are bonded, according to the embodiment of the present disclosure.
Figure 5:
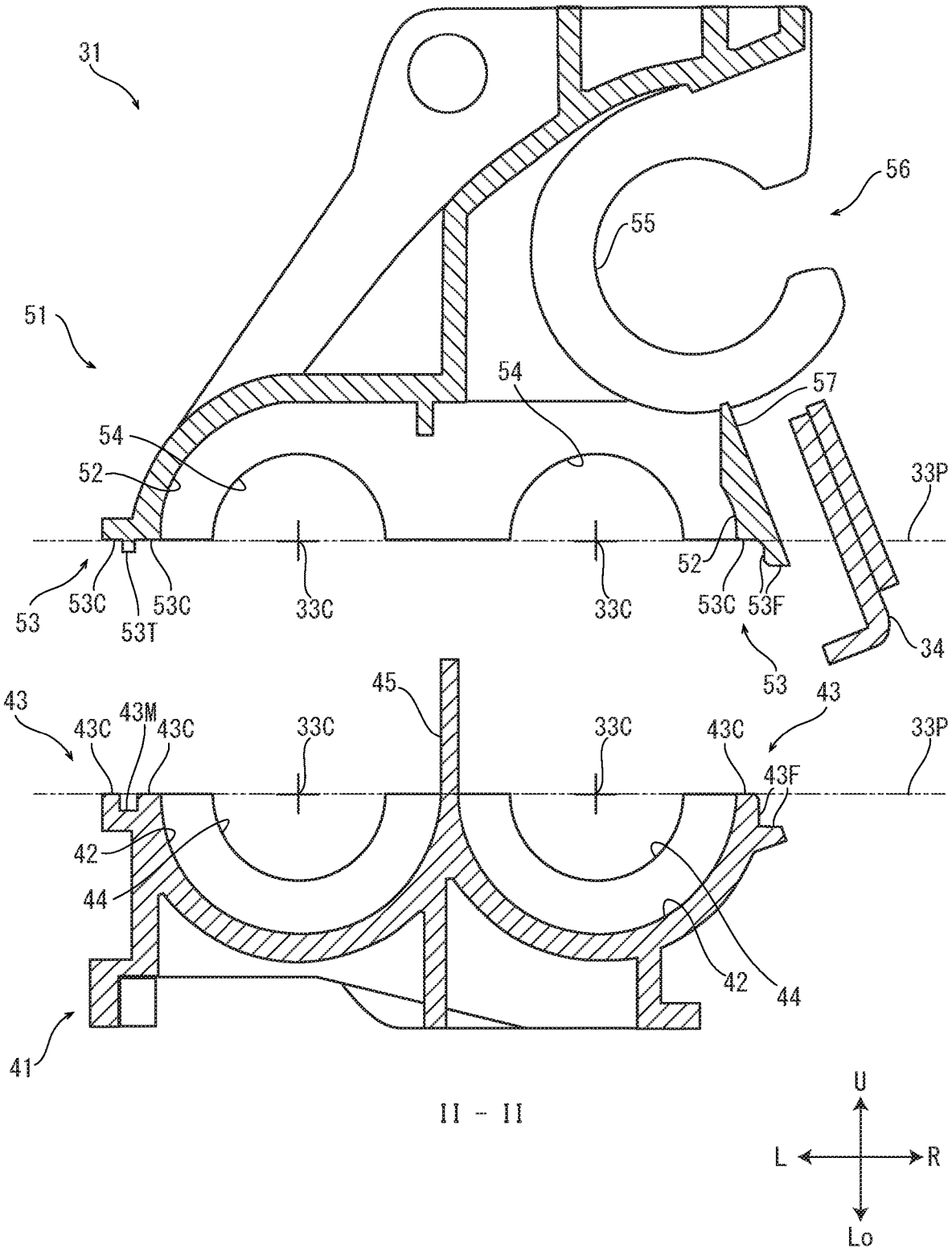
FIG. 5 is a sectional view taken along II-II line of FIG. 3.
Figure 6:
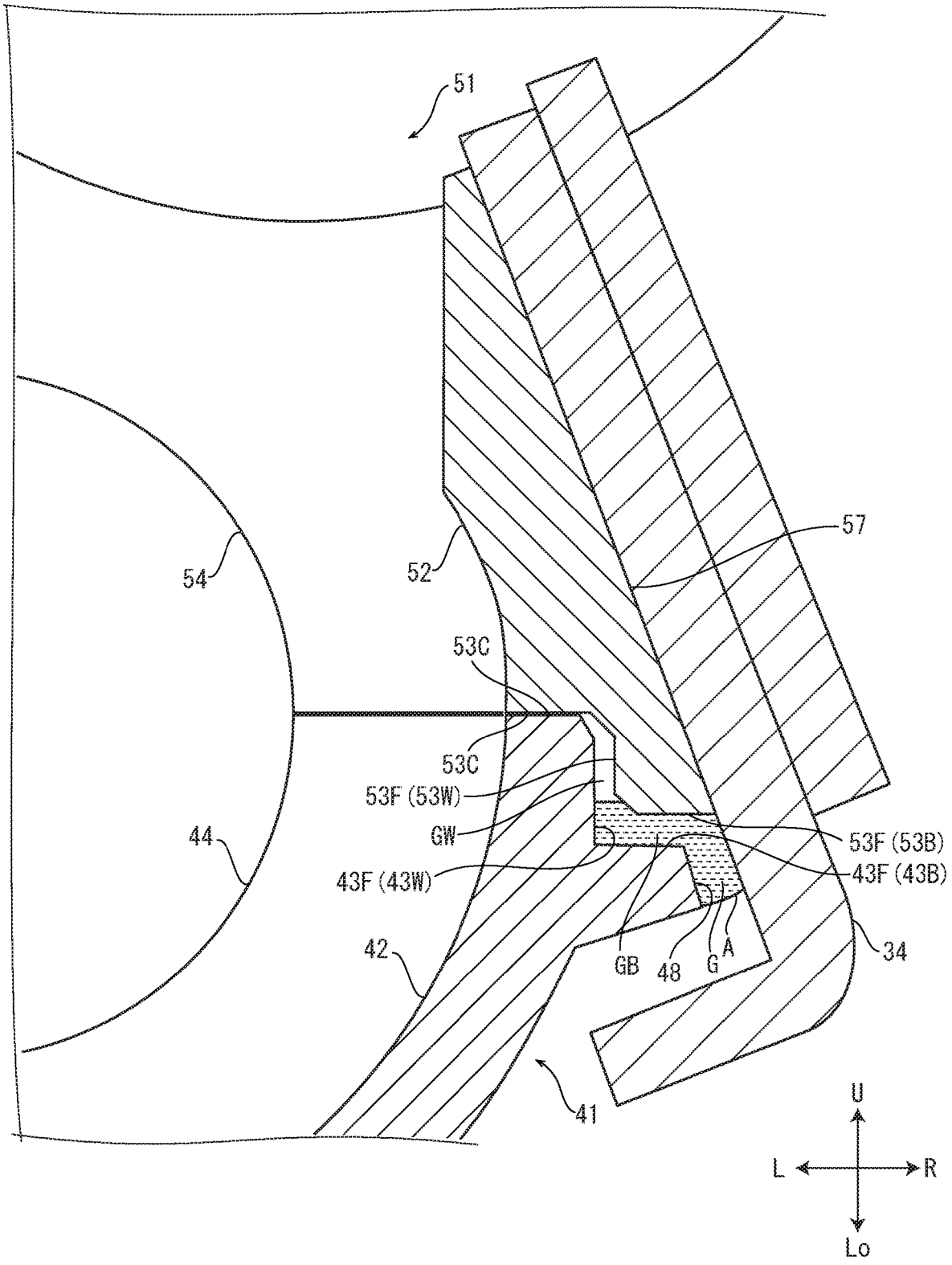
FIG. 6 is an enlarged sectional view showing a part at a side of a blade member in the housing in FIG. 4.
Figure 7:
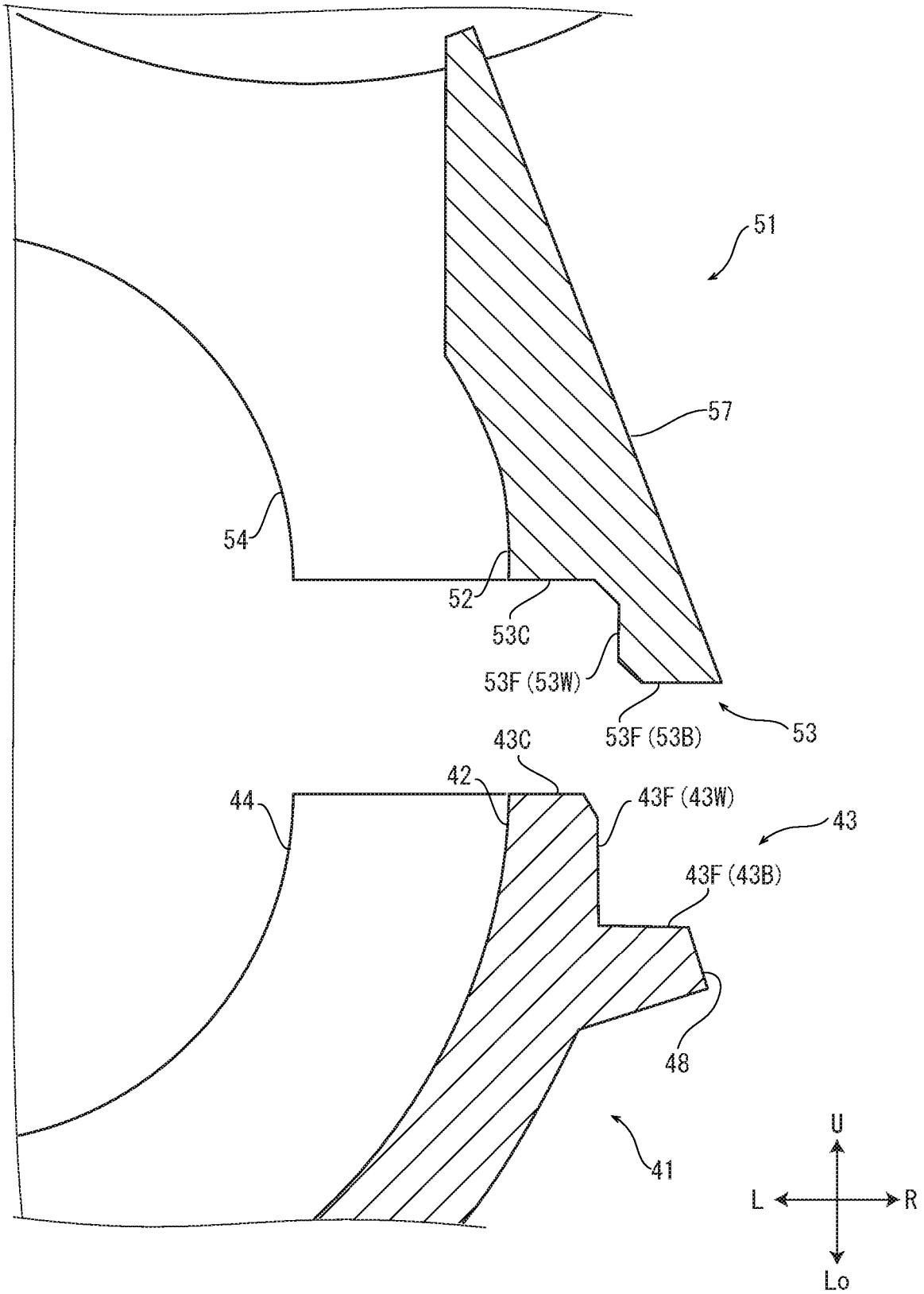
FIG. 7 is an enlarged sectional view showing a part at the side of the blade member in the housing of FIG. 5.

Next, with reference to FIGS. 2-7, the housing 31 and the blade member 34 will be described. FIG. 3 is a perspective view showing the housing 31, in a condition before a lower housing 41 and an upper housing 51 are bonded. FIG. 4 is a sectional view taken along I-I line of FIG. 2. FIG. 5 is a sectional view taken along II-II line of FIG. 3. FIG. 6 is an enlarged sectional view showing a part at a side of the blade member 34 in the housing 31 of FIG. 4. FIG. 7 is an enlarged sectional view showing a part at the side of the blade member 34 in the housing 31 of FIG. 5.

The housing 31 of the developing device 16 has a hollow configuration extended in forward and backward directions as a longitudinal direction and, inside the housing 31, the screws 33, the magnetic roller 32 and the developer supplied from the developer container 12 are housed. As shown in FIGS. 3-5, the housing 31 includes the lower housing 41 and the upper housing 51 and is formed by bonding the lower housing 41 and the upper housing 51. The lower housing 41 and the upper housing 51 are made by injection molding using a resin. The lower housing 41 includes a first housing part 42 having an upper part opened at an upper side, and houses the screws 33 in the first housing part 42. The upper housing 51 includes a second housing part 52 having a lower part opened at a lower side, and houses the screws 33 and the magnetic roller 32 in the second housing part 52, and in the upper housing 51, the opening 56 for exposing the part of the outer circumferential face of the magnetic roller 32 is formed.

The first housing part 42 has the upper part being opened, is formed in a recess shape recessed to a lower side, and provides a space in the forward and backward directions as a longitudinal direction. A cross section of the first housing part 42 as viewed from the front side has a shape of two semicircles juxtaposed in the left and right directions, and a partition 45 extended in the forward and backward directions as a longitudinal direction is formed at a center of the first housing part 42 in the left and right directions. At left and right sides of the partition 45, the screws 33 are respectively arranged. At a front end and a rear end of the lower housing 41, bearing supporting parts 44 to which bearings for the screws 33 are fitted are formed. Between a front end of the first housing part 42 and a front end of the partition 45, and between a rear end of the first housing part 42 and a rear end of the partition 45, apertures 46 are formed, and then, a circulating path for conveying the developer is arranged around the partition 45.

The second housing part 52 has the lower part being opened, is formed in a recess shape recessed to an upper side, and provides a space in the forward and backward directions as a longitudinal direction. At a front end and a rear end of the upper housing 51, bearing supporting parts 54 to which the bearings for the screws 33 are fitted are formed. Above the right bearing supporting part 54, bearing supporting parts 55 to which the bearings for the magnetic roller 32 are fitted are formed. The opening 56 is formed at the right side of the magnetic roller 32.

First edges 43 of the first housing part 42 include first contact faces 43C. Concretely, as shown in FIG. 5, in the first edges 43, the first contact faces 43C facing to the upper housing 51 are formed. The first contact faces 43C is included in a same plane 33P including centers 33*c* of axes of the screws 33 over the whole area. In the first edge 43, a plurality of bosses 47 protruding to the upper side are formed (refer to FIG. 3).

Second edges 53 of the second housing part 52 include second contact faces 53C coming into contact with the first contact faces 43C. Concretely, as shown in FIG. 5, in the second edges 53, the second contact faces 53C coming into contact with the first contact faces 43C are formed. The second contact faces 53C is included in the same plane 33P over the whole area. In the second edge 53, hole parts to which the bosses 47 of the first edge 43 are fitted are formed (not shown).

As shown in FIGS. 2-5, the blade member 34 is a plate-like member extended in the forward and backward directions as a longitudinal direction and is made of metal. An upper part of the blade member 34 is fixedly attached to an outer face of the upper housing 51, and a lower part of the blade member 34 faces to an outer face 48 of the lower housing 41 to make a gap G between the blade member 34 and the lower housing 41 (refer to FIG. 6). In the outer face of the upper housing 51 below the opening 56, a blade attachment face 57 to which the blade member 34 is attached is formed. The blade attachment face 57 is formed at a planer shape inclined to be lower from the left side to the right side, and a plurality of threaded screw holes 57H (refer to FIG. 3) are formed in the blade attachment face 57. In the blade member 34, threaded screw holes 34H corresponding to the threaded screw holes 57H are formed.

As shown in FIG. 5, a part of the first edge 43 positioned between the first housing part 42 and the blade member 34 includes a first facing surface 43F formed at a side of the blade member 34 from the first contact face 43C. The second edge 53 includes a second facing surface 53F facing to the first facing surface 43F.

A gap between the first facing surface 43F and the second facing surface 53F is made so that a width at a side of the blade member 34 is broader than a width at a side of the first contact face 43C. Concretely, as shown in FIG. 7, the first facing surface 43F includes a first bottom face 43B formed at a position lower than the first contact face 43C and a first wall face 43W formed between the first contact face 43C and the first bottom face 43B. The second facing surface 53F includes a second bottom face 53B formed at a position lower than the second contact face 53C and a second wall face 53W formed between the second contact face 53C and the second bottom face 53B. In other words, the first facing surface 43F and the second facing surface 53F are arranged so that an interval at a side of the blade member 34 between the first facing surface 43F and the second facing surface 53F is broader than an interval at a side of the first contact face 43C between the first facing surface 43F and the second facing surface 53F.

As shown in FIG. 6, a gap GB between the first bottom face 43B and the second bottom face 53B is broader than a gap GW between the first wall face 43W and the second wall face 53W. The first facing surface 43F and the second facing surface 53F are bonded by an adhesive agent A, and the gap G between the blade member 34 and the outer face 48 of the lower housing 41 is sealed by the adhesive agent A.

As shown in FIG. 5, a part of the first edge 43 positioned at the left side from the first housing part 42 (at an opposite to the blade member 34) includes a groove 43M extended in the forward and backward directions. the second edge 53 includes a protruding part 53T fitted to the groove 43M.

Figure 8:
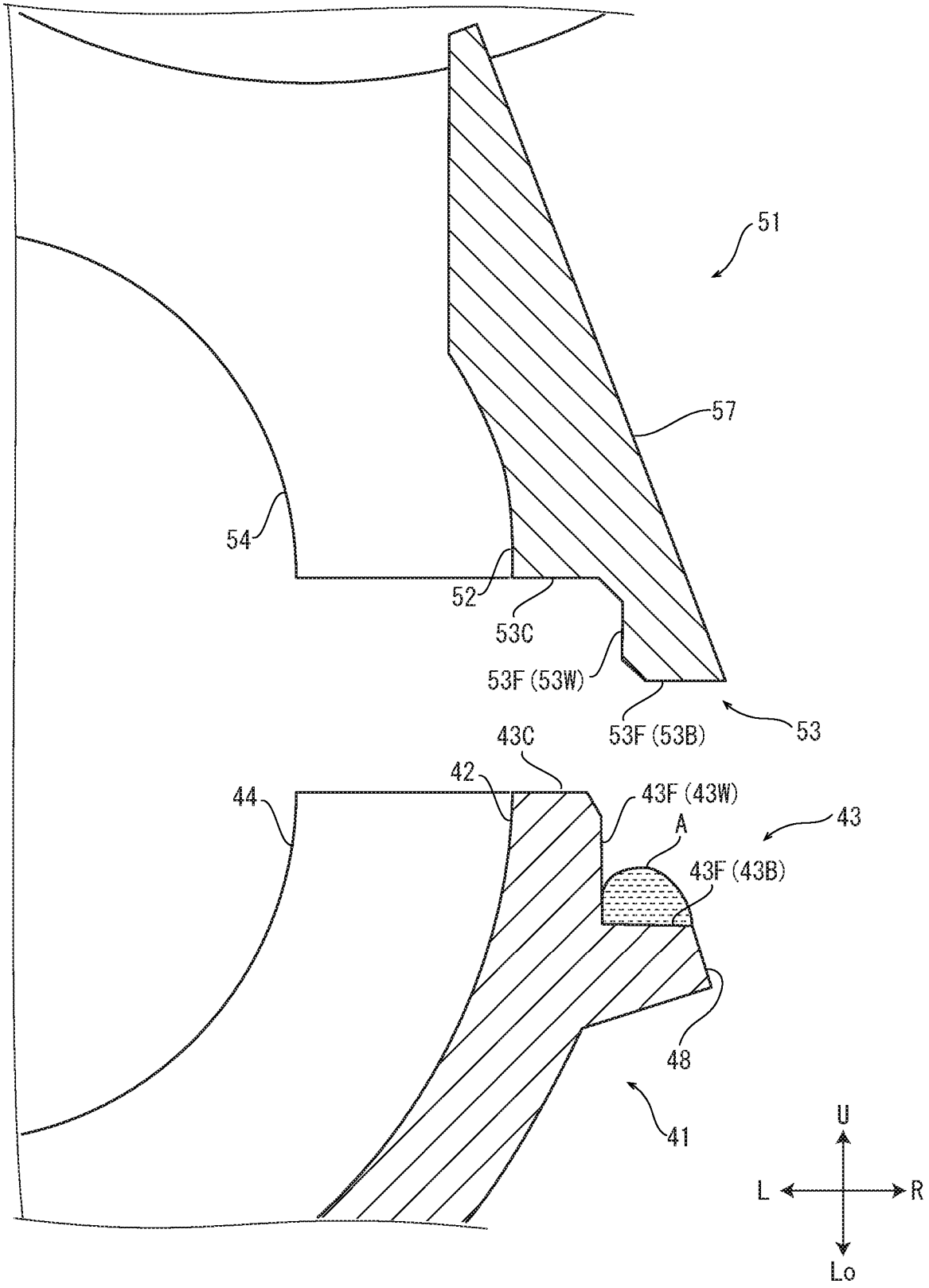
FIG. 8 is an enlarged sectional view showing the part at the side of the blade member, in a condition that an adhesive agent is applied to a first bottom face, in the housing of FIG. 5.
Figure 9:
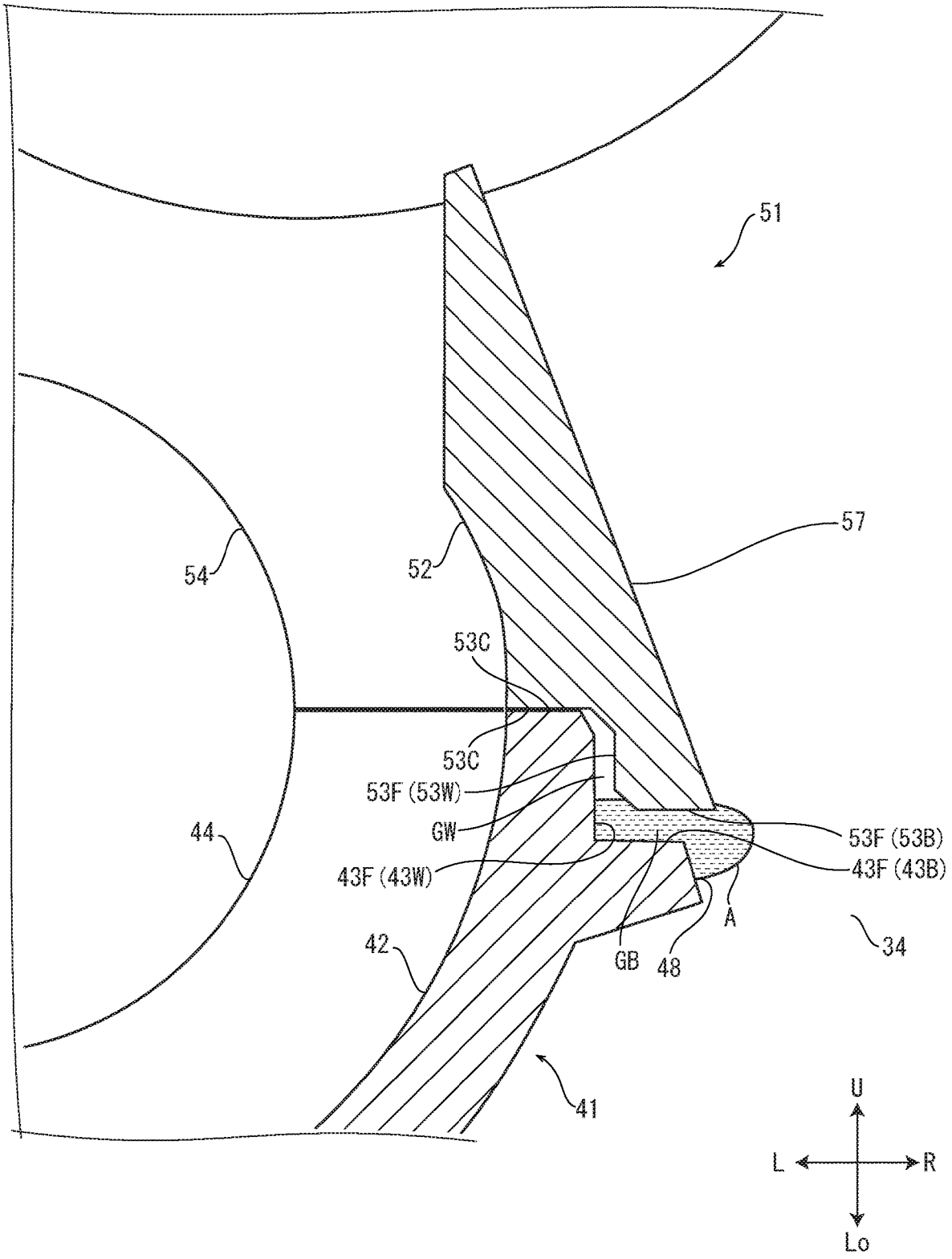
FIG. 9 is an enlarged sectional view showing the part at the side of the blade member, in a condition that the lower housing and the upper housing are bonded, in the housing of FIG. 4.

Next, with reference to FIGS. 6-9, assembling procedure of the housing 31 will be described in detail. FIG. 8 is a sectional view showing a part of the housing 31 in a condition that the adhesive agent A is applied to the first bottom face 43B. FIG. 9 is a sectional view showing a part of the housing 31 in a condition that the upper housing 51 is bonded to the lower housing 41.

First, as shown in FIG. 8, the adhesive agent A is applied to the first bottom face 43B. The adhesive agent A is, for example, a hot melt adhesive, and a predetermined quantity of the adhesive agent A is applied by using a dispenser. At this time, the adhesive agent A may be applied to the groove 43M.

Subsequently, as shown in FIG. 9, the upper housing 51 is bonded to the lower housing 41. Concretely, the bosses 47 (refer to FIG. 3) are inserted to the hole parts (not shown) and the protruding part 53T is inserted to the groove 43M, and thereby, the upper housing 51 is positioned and the second contact face 53C comes into contact with the first contact face 43C. Accordingly, the gap GB is made between the first bottom face 43B and the second bottom face 53B, and the gap GW is made between the first wall face 43W and the second wall face 53W. The adhesive agent A is pressed in upward and downward directions by being caught between the first bottom face 43B and the second bottom face 53B, and the second bottom face 53B is bonded to the first bottom face 43B. At this time, since the adhesive agent A has high viscosity, the adhesive agent A is hardly flowed from a broad space to a narrow space. In this example, since the gap GB between the first bottom face 43B and the second bottom face 53B is broader than the gap GW between the first wall face 43W and the second wall face 53W, the adhesive agent A is hardly flowed from the gap GB to the gap GW, and then, is flowed out from the gap GB to a space at the right side (at a side of the blade member 34) and risen.

Continuously, as shown in FIG. 6, the blade member 34 is attached. Concretely, the upper part of the blade member 34 is attached to the blade attachment face 57 of the upper housing 51 by using screws. The lower part of the blade member 34 makes the gap G with regard to the outer face 48 of the lower housing 41. At this time, the lower part of the blade member 34 presses the adhesive agent A risen to the right side, and the pressed adhesive agent A is flowed to the lower side.

Thus, the first facing surface 43F and the second facing surface 53F are bonded by an adhesive agent A, and the gap G between the blade member 34 and the outer face 48 of the lower housing 41 is sealed by the adhesive agent A. Since the adhesive agent A is hardly flowed to the gap GW between the first wall face 43W and the second wall face 53W, the adhesive agent A becomes hard to protrude a side of the first housing part 42. In addition, since no sealing member, such as sponge, is required, man-hours and material cost are decreased.

In accordance with the above-described developing device 16 according to the embodiment, it is possible to prevent the adhesive agent A from protruding to the inside of the housing 31 and to simplify sealing between the blade member 34 and the housing 31.

Moreover, in accordance with the developing device 16 according to the embodiment, if the adhesive agent A is flowed to the gap GW between the first wall face 43W and the second wall face 53W, since gravity acts in a direction of preventing the adhesive agent A from rising inside the gap GW, in comparison with a case where the first wall face 43W and the second wall face 53W are not provided, effect of preventing the adhesive agent A from protruding to the inside of the housing 31 is heightened.

Further, in accordance with the developing device 16 according to the embodiment, since the adhesive agent A is applied to the first bottom face 43B and the first bottom face 43B and the second bottom face 53B are bonded, in comparison with a case where the first wall face 43W and the second wall face 53W bonded in addition to bonding of the first bottom face 43B and the second bottom face 53B, effect of preventing the adhesive agent A from protruding to the inside of the housing 31 is heightened and it is possible to decrease a use quantity of the adhesive agent A.

Furthermore, in accordance with the developing device 16 according to the embodiment, since the first contact faces 43C and the second contact faces 53C are included in the same plane 33P including the centers 33*c* of axes of the screws 33 over the whole area, strength and rigidity of the housing 31 are improved.

The above-described embodiment may be modified as follows.

Figure 10:
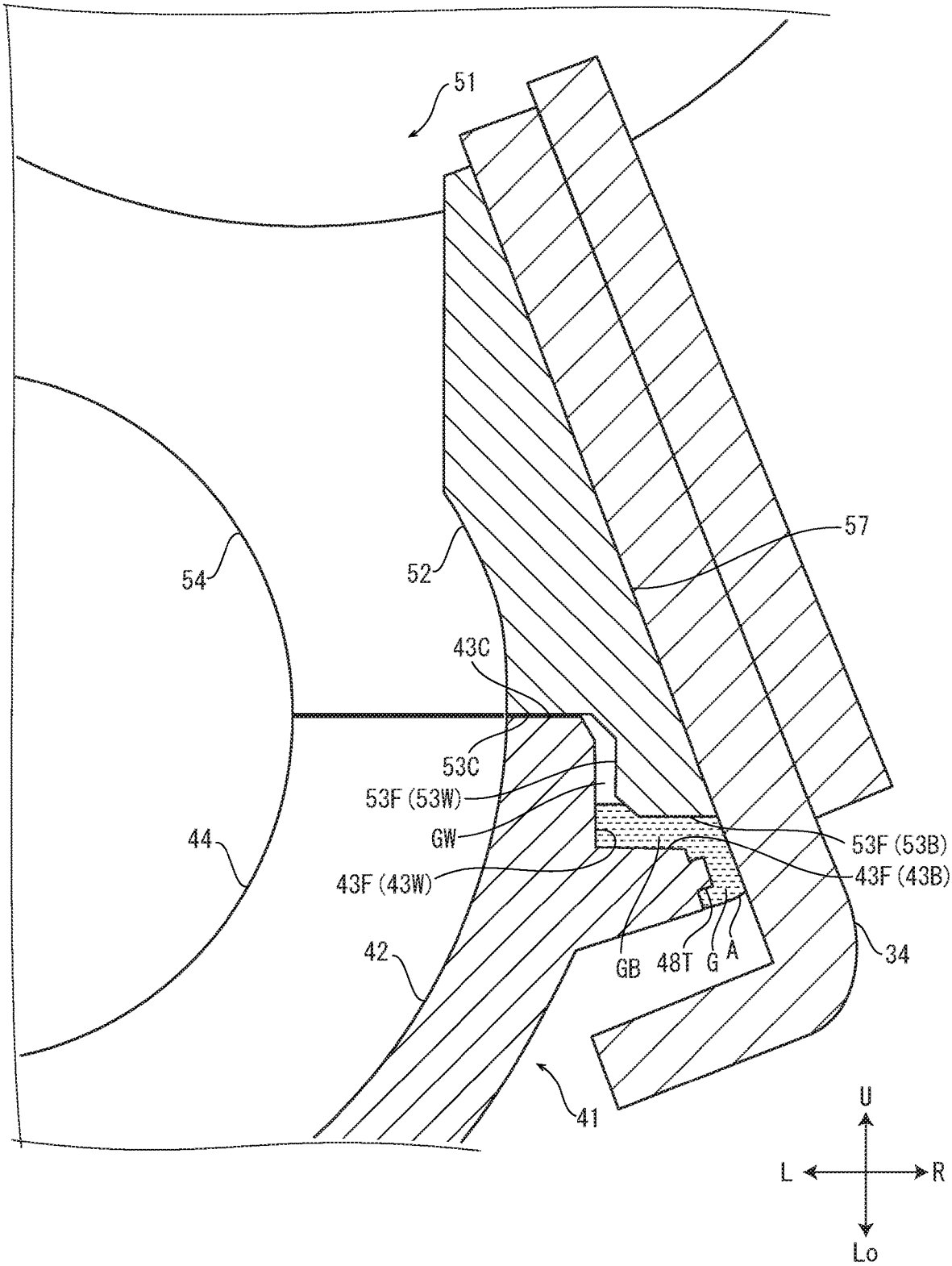
FIG. 10 is an enlarged sectional view showing a modified example of the developing device according to the embodiment of the present disclosure.

FIG. 10 is a sectional view showing a modified example of the developing device 16 of the above-described embodiment. In this example, in addition to a configuration of the developing device 16 of the above-described embodiment, the outer face 48 of the lower housing 41 includes a protruding part 48T having a thickness of not contacting with the blade member 34. In accordance with the modified example, in comparison with the above-described embodiment, since a capacity of the gap G between the outer face 48 of the lower housing 41 and the blade member 34 is decreased, it is possible to reduce a use quantity of the adhesive agent A. Moreover, in comparison with the above-described embodiment, since the gap G is narrowed, it is possible to reduce a quantity of the adhesive agent A flowing down from the gap G.

Figure 11:
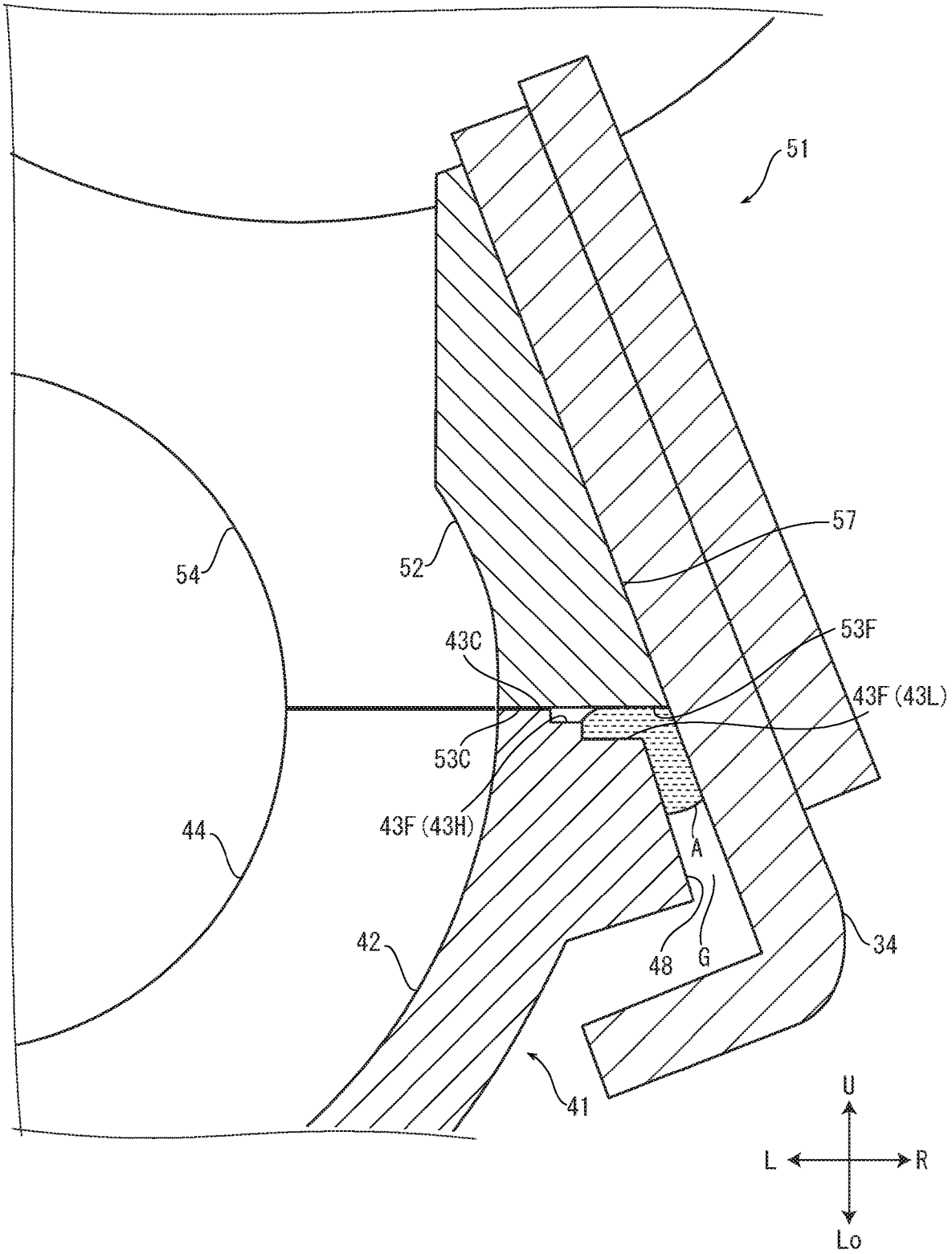
FIG. 11 is an enlarged sectional view showing a modified example of the developing device according to the embodiment of the present disclosure.
Figure 12A:
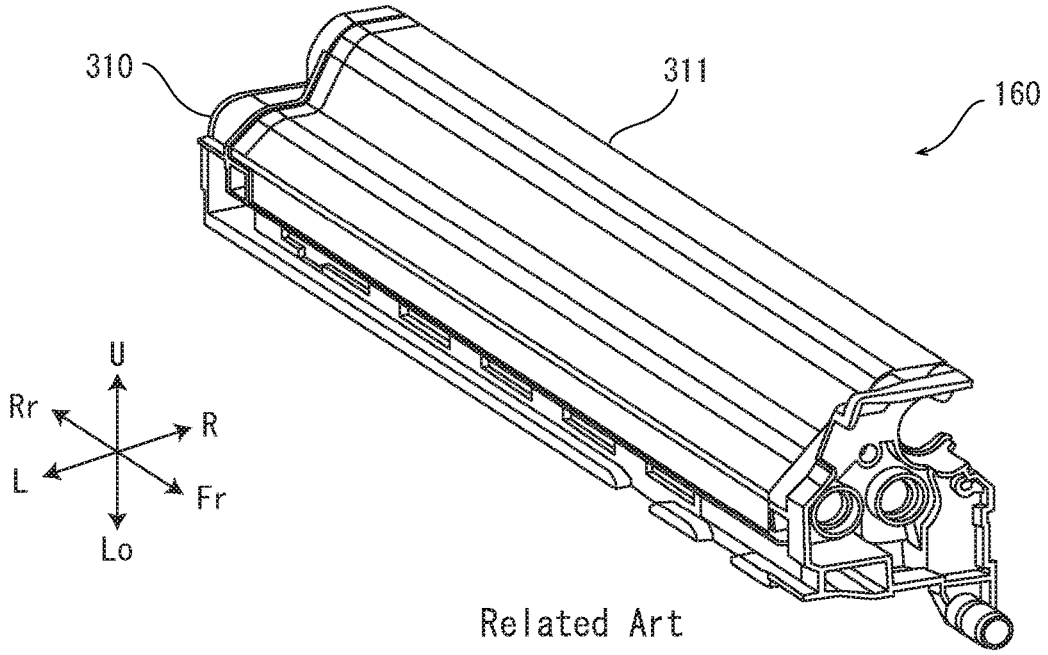
FIG. 12A is a perspective view showing an outside appearance of a conventional developing device.
Figure 12B:
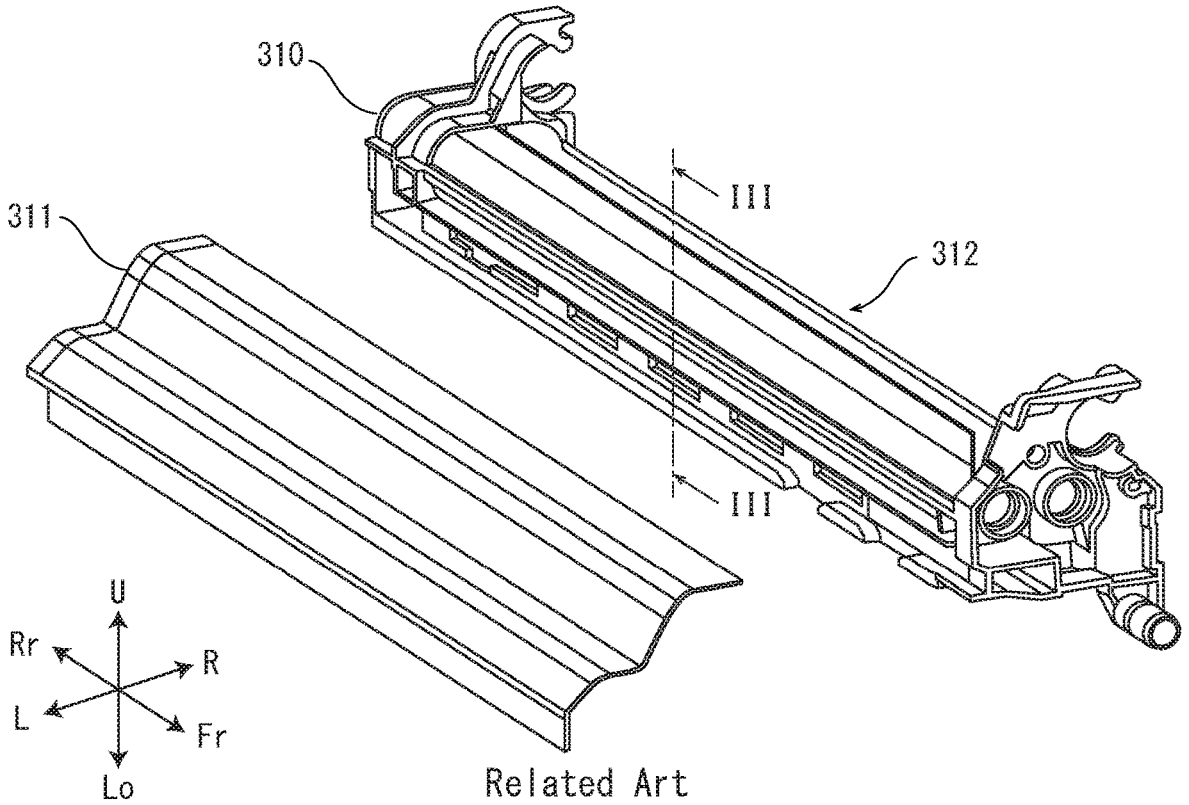
Related Art FIG. 12B
FIG. 12B is an exploded perspective view showing the conventional developing device, in a condition that a cover is detached from a housing.
Figure 13:
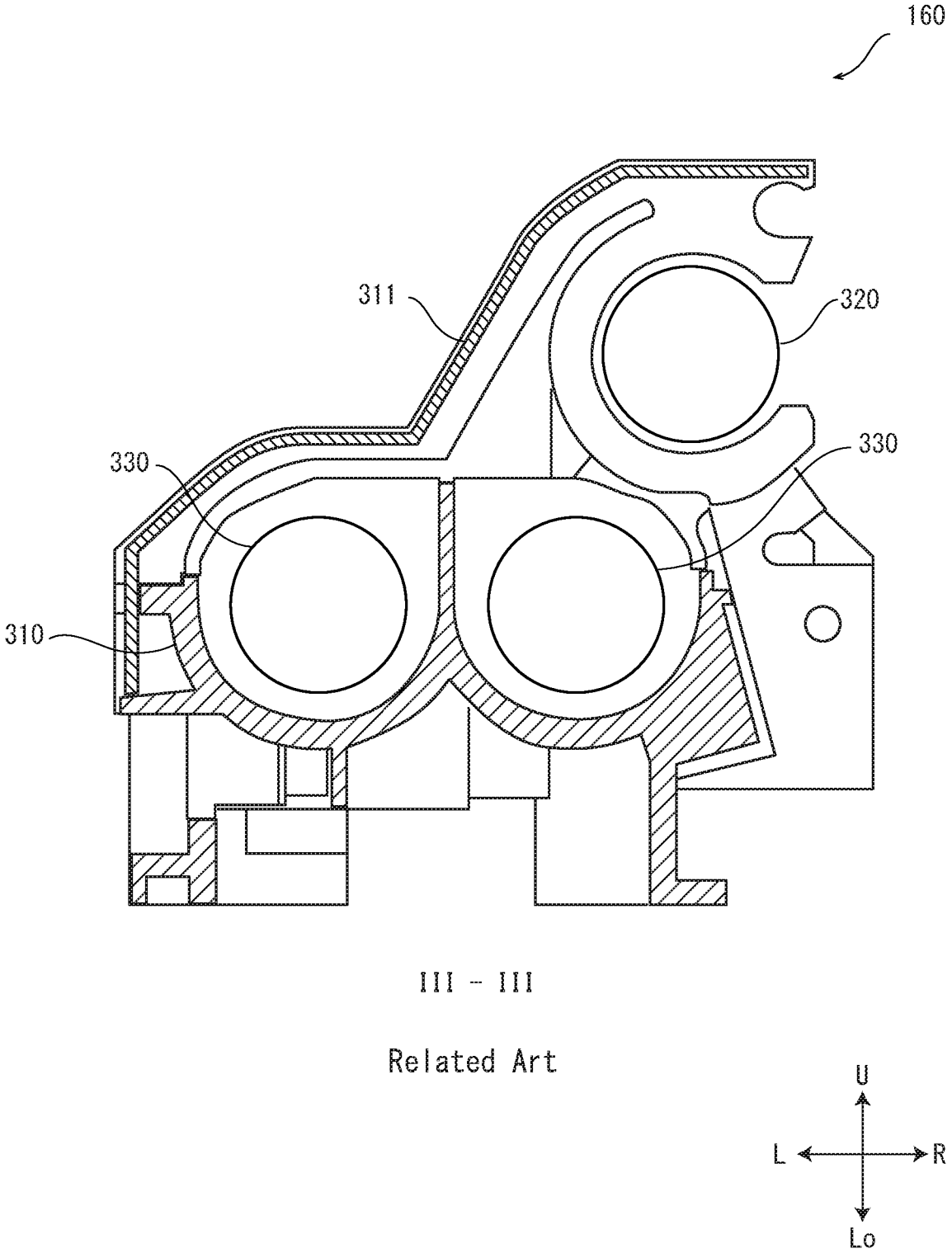
FIG. 13 is a sectional view taken along III-III line of FIG. 12B.

FIG. 11 is a sectional view showing a modified example of the developing device 16 of the above-described embodiment. In this example, the first facing surface 43F is formed in a stepwise shape having a high elevation face 43H at a side of the first contact face 43C and a lower elevation face 43L at a side of the blade member 34. The second facing surface 53F is formed at the same level as the second contact face 53C. That is, in this example, a gap between the first facing surface 43F and the second facing surface 53F is made so that a width at a side of the blade member 34 is broader than a width at a side of the first contact face 43C. The adhesive agent A is applied to the lower elevation face 43L, and then, the lower elevation face 43L and the second facing surface 53F are bonded. Since the adhesive agent A is hardly flowed from a side of the lower elevation face 43L to a side of the high elevation face 43H, the adhesive agent A becomes hard to protrude to a side of the first housing part 42. Therefore, by the present modified example, it is also possible to prevent the adhesive agent A from protruding to the inside of the housing 31 and to simplify sealing between the blade member 34 and the housing 31.

Although the above-described embodiment illustrates an example that the gap GW is made between the first wall face 43W and the second wall face 53W, in a further modified example, the first wall face 43W and the second wall face 53W may be come into contact with each other. In accordance with the present modified example, in comparison with the above-described embodiment, effect of preventing the adhesive agent A from protruding to the inside of the housing 31 is heightened.

Although the above-described embodiment illustrates an example that the first contact faces 43C and the second contact faces 53C are included in the same plane 33P including the centers 33*c* of axes of the screws over the whole area, in another example, the first contact faces 43C and the second contact faces 53C may be included in the same plane not including the centers 33*c* of axes of the screws 33 over the whole area. Alternatively, in another example, the first contact faces 43C and the second contact faces 53C may not be included in the same plane over the whole area.

Although the above-described embodiment illustrates an example that the first edge 43 includes the groove 43M and the second edge 53 includes the protruding part 53T, in another example, the groove 43M and the protruding part 53T may not be provided. Alternatively, in another example, in place of the groove 43M and the protruding part 53T, the first facing surface 43F and the second facing surface 53F may be provided similarly to a side of the blade member 34.

Although the present embodiment has been described about a case where a configuration of the present disclosure is applied to the printer 1 forming the color image with the toners of four colors, in another different embodiment, the configuration of the disclosure may be applied to another different image forming apparatus, such as a monochrome printer, a copying machine, a facsimile or a multifunction peripheral, including the developing device.

Moreover, the present disclosure may be suitably varied within range not contrary to summary or idea of the disclosure been readable from the claims and the whole of the specification, and a developing device, an image forming apparatus and a method for manufacturing the developing device having such variation is also included in technical idea of the disclosure.

The invention claimed is:

1. A developing device comprising:

an agitating member rotating around an axis to agitate a developer;

a magnetic roller arranged above the agitating member and carrying the developer;

a lower housing including a first housing part opened at an upper side to house the agitating member in the first housing part;

an upper housing including a second housing part opened at a lower side to house the agitating member and the magnetic roller in the second housing part, and including an opening from which a part of an outer circumferential face of the magnetic roller is exposed; and a blade member arranged below the opening, having an upper part fixedly attached to an outer face of the upper housing, having a lower part facing to an outer face of the lower housing to make a gap between the blade member and the lower housing, and restricting a layer thickness of the developer carried on the magnetic roller, wherein the first housing part has a first edge including a first contact face, the second housing part has a second edge including a second contact face coming into contact with the first contact face, a part of the first edge positioned between the first housing part and the blade member includes a first facing surface formed at a side of the blade member from the first contact face, the second edge includes a second facing surface facing to the first facing surface, a gap between the first facing surface and the second facing surface is made so that a width at a side of the blade member is broader than a width at a side of the first contact face, the first facing surface and the second facing surface are bonded by an adhesive agent, the gap between the blade member and the outer face of the lower housing is sealed by the adhesive agent.

2. The developing device according to claim 1 wherein, the first facing surface includes a first bottom face formed at a position lower than the first contact face and a first wall face formed between the first contact face and the first bottom face, the second facing surface includes a second bottom face formed at a position lower than the second contact face and a second wall face formed between the second contact face and the second bottom face, a gap between the first bottom face and the second bottom face is broader than a gap between the first wall face and the second wall face.

3. The developing device according to claim 2 wherein, the first bottom face and the second bottom face are bonded.

4. The developing device according to claim 2 wherein, the first wall face and the second wall face come into contact with each other.

5. The developing device according to claim 1 wherein, the outer face of the lower housing includes a protruding part having a thickness of not contacting with the blade member.

6. The developing device according to claim 1 wherein, the first contact face and the second contact face are included in the same plane over the whole area.

7. The developing device according to claim 1 wherein, the first contact face and the second contact face are included in the same plane including a center of an axis of the agitating member over the whole area.

8. The developing device according to claim 1 wherein, the first facing surface is formed in a stepwise shape having a high elevation face at a side of the first contact face and a lower elevation face at a side of the blade member, the second facing surface is formed at the same level as the second contact face.

9. An image forming apparatus comprising:

an exposing device writing a latent image on a photosensitive drum; and the developing device according to claim 1 to develop the latent image.

10. A method for manufacturing a developing device including:

a lower housing including a first housing part opened at an upper side;

an upper housing including a second housing part opened at a lower side; and a blade member having an upper part fixedly attached to an outer face of the upper housing, and having a lower part facing to an outer face of the lower housing to make a gap between the blade member and the lower housing, the method comprising:

a step of forming a first contact face on a first edge of the first housing part, a step of forming a second contact face coming into contact with the first contact face on a second edge of the second housing part, a step of forming a first facing surface on a part of the first edge positioned between the first housing part and the blade member at a side of the blade member from the first contact face, a step of forming a second facing surface facing to the first facing surface on the second edge, a step of arranging the first facing surface and the second facing surface so that an interval at a side of the blade member between the first facing surface and the second facing surface is broader than an interval at a side of the first contact face between the first facing surface and the second facing surface, a step of applying an adhesive agent to the first facing surface, a step of making the second contact face come into contact with the first contact face, and of bonding the second facing surface to the first facing surface, a step of fixedly attaching an upper part of the blade member to the outer face of the upper housing, and of sealing the gap between the blade member and the outer face of the lower housing by the adhesive agent flowed out from between the first facing surface and the second facing surface.

* * * * *